United States Patent [19]

Reusser

[11] 3,990,206

[45] Nov. 9, 1976

[54] BUILDING SHEET

[75] Inventor: Hans E. Reusser, Westlake, Ohio

[73] Assignee: Republic Steel Corporation, Cleveland, Ohio

[22] Filed: June 16, 1975

[21] Appl. No.: 586,978

[52] U.S. Cl. ..... 52/534; 52/521; 52/537; 52/630

[51] Int. Cl.[2] ..... E04D 3/30

[58] Field of Search ..... 52/521, 534, 537, 630

[56] References Cited

UNITED STATES PATENTS

| | | | |
|---|---|---|---|
| 1,144,725 | 6/1915 | Probert | 52/534 |
| 1,710,890 | 4/1929 | Ochiltree | 52/521 |
| 1,912,486 | 6/1933 | Krantz | 52/521 |
| 2,073,706 | 3/1937 | Overholtz | 52/521 |
| 2,166,275 | 7/1939 | Williams | 52/553 X |
| 3,667,185 | 6/1972 | Maurer | 52/537 |

FOREIGN PATENTS OR APPLICATIONS

| | | | |
|---|---|---|---|
| 255,261 | 11/1964 | Australia | 52/537 |

*Primary Examiner*—Alfred C. Perham
*Attorney, Agent, or Firm*—Watts, Hoffmann, Fisher & Heinke

[57] ABSTRACT

A building sheet suitable for roofing and siding use that accommodates fastening along ribs or valleys of a side lapped juncture between two sheets. Strengthening ribs formed from bends in the sheet are shaped to promote stacking, to consume little of the sheet width, and to avoid sharp bends that crack protective coatings. An anti-siphon gap is provided between each lapped and lapping rib, extending the full height of the lapped rib adjacent the lapping edge. A drain trough formed at the base of the gap carries away any water that leaks beneath the overlapping sheet. Low ribs delineate channels in which fasteners can be driven to engage an underlapped edge at a side lap juncture between sheets. A top flat surface of high ribs is narrow enough for stiffness to inhibit deformation by fasteners and restricts the fasteners to locations that avoid drain penetration at side laps.

8 Claims, 4 Drawing Figures

BUILDING SHEET

BACKGROUND OF THE INVENTION

1. Field of the Invention

This invention relates to building sheets, typically of metal, suitable for roofing and siding for buildings.

2. Prior Art.

A variety of roofing and siding sheets are available for use in the fabrication of factories, farm and commerical buildings and the like. Typically, such sheets are metal, such as steel, with formed ribs for section strength. Preferably, the sheets and necessary ribbing should be pleasing in appearance, should stack compactly for storage and shipment, should be capable of being lapped along marginal sides to provide weatherproof junctures, the overlapped juncture should resist distortion from fasteners when secured to a building frame, and the width reduction in the sheet from the ribbing should be small. While these desiderata are common to most building panels of this type, the degree to which they are achieved varies. One difficulty is that variations in one feature or characteristic affect others, so that an enhancement of one feature is often only achieved at the expense of another.

One significant feature lacking in presently used sheets of this type is a choice of fastener location through either a valley or a rib along the side lap of two sheets, especially coupled with a construction that assures the proper location of fasteners at the juncture to avoid distorting the overlapping edge of the top sheet or piercing of the typically provided drain groove of a rib that is hidden beneath the overlapping sheet at the side lap area.

SUMMARY OF THE INVENTION

The present invention relates to building sheets suitable for roofing and siding and provides a sheet construction that is attractive in appearance, relatively rigid and strong, weathertight at side laps, that facilitates high density stacking, and affords a choice of valley or rib fastening at the side lap, without risk of edge distortion from fasteners and with assurance of proper location of the fasteners relative to underlying portions of the lapped sheet.

A preferred embodiment of the invention provides a plurality of high ribs to provide sectional strength and resistance to deflection. The number and height of the high ribs is kept to a minimum consistent with adequate strength, to minimize comsumption of sheet width and to provide a relatively wide area of repeating pattern that gives a textured look without monotony. All bends used to form ribs and valleys have a substantial radius to avoid microcracking of a protective coating, such as a galvanized metal coating or an organic coating on the sheet. Side walls of the formed ribs are inclined relative to the plane of the valleys and converge in a direction away from the plane so that identical sheets will nest when stacked.

An improved margin construction is utilized along one side edge of the sheet that is lapped in use by an opposite marginal edge of an identical sheet, to provide a juncture that is highly leak resistance, a choice of valley or rib fastening, and an ability to resist distortion from the fasteners. To this end, the improved margin construction includes a high rib with a narrow, flat, top surface, a drain trough extending along a side of the rib that faces inwardly of the sheet, and a flat valley portion projecting from the opposite side of the rib from the drain and forming the edge of the sheet.

The drain trough creates an internal gap between otherwise adjacent surfaces of a lapped juncture to interrupt any inward flow of water from beneath the overlapping sheet. The trough is so placed that before leakage beneath the exposed edge of the lapping sheet can pass through the juncture, it must bridge the internal gap and also travel upwardly and across the high rib.

The flat valley portion is constructed to underlie a valley of equal width on the margin of the overlapping sheet. The overlying valley is located inwardly of a high rib that nests over the high rib and drain groove of the lapped sheet. This construction accommodates valley fasteners in the side lap inwardly of the rib and exposed edge of the lapping sheet, where the fasteners will not distort the exposed edge, a condition which would be detrimental to the weather seal.

The flat top surfaces of the lapped and lapping ribs are of essentially equal width and are to one side of the drain groove, which underlies a sloped side of the lapping rib. This assures that fasteners at any place in the flat part of a rib will not pass through the underlying drain trough.

Additional ribs of lower profile provide guidance channels indicating the proper location of valley fasteners, and add additional section strength.

By virtue of the above features, an attractive and improved building sheet is provided, suited to low slopes where leakage resistance is most critical, and to long spans where rigidity, i.e., high sectional strength, is required.

The above and other features and advantages of this invention will become better understood by reference to the detailed description that follows, when considered in connection with the accompanying drawings.

DETAILED DESCRIPTION OF A PREFERRED EMBODIMENT

Figure 1:
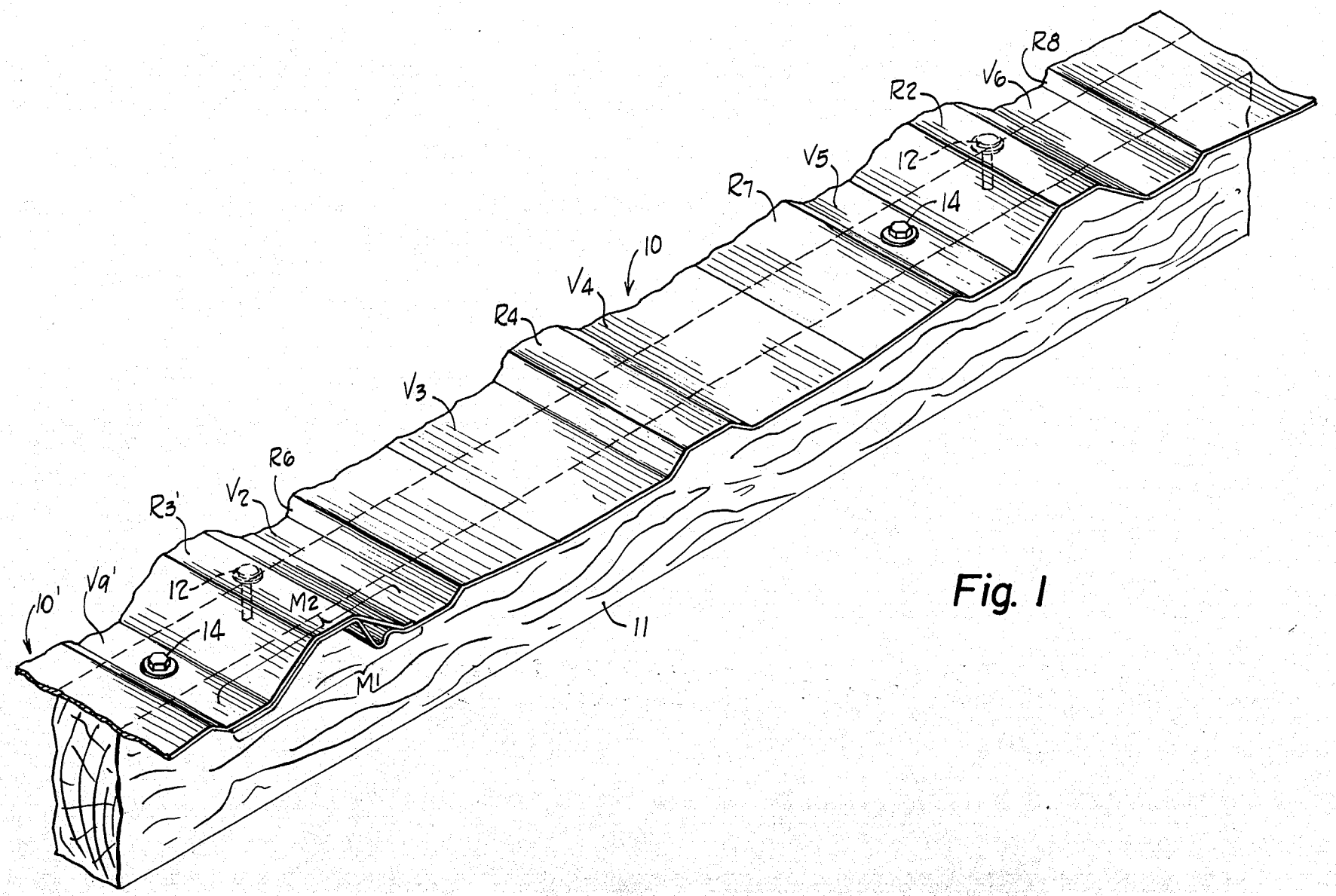
FIG. 1 is a partial perspective view of a building sheet embodying the present invention, illustrating the manner in which two adjacent, identically constructed, sheets are side lapped to provide a weatherproof juncture, and indicating the location of alternatively utilized rib fasteners and valley fasteners.

With reference to the drawings, a building sheet 10 embodying the present invention is shown in part in FIG. 1, supported on a wooden frame member, such as a purlin 11. A second identical sheet 10' is shown in partial overlapping relationship, illustrating the manner in which successive sheets are side lapped to cover an area larger than a single sheet. The sheets 10, 10' are shown in FIG. 1 as they are typically supported to form a roof. A plurality of ribs R and valleys V of the sheets 10, 10' extend the length of the sheets and are oriented in use in a direction from the roof peak to the eaves. Purlins 11 run across roof joists at right angles to the extent of the ribs, to support the sheets in the plane of the valleys V, which rest against the purlins. The sheets are secured in place by fasteners, such as by the nails 12 through selected ribs, or by screws 14 in selected valleys. When the sheets are used as siding, wooden strips called girts are applied across upright studs of the building frame to support the sheets in the same manner that the purlins 11 do on a roof, and the ribs R and valleys V extend vertically.

Each sheet 10, 10' has two side margin portions M1, M2 that are overlapped with an adjacent sheet to form a so-called "side lap." As shown in FIG. 1, the margin portion M1 of sheet 10 is overlapped by the margin portion M2 of sheet 10'. The ribs R formed in the margin portions of the sheets are constructed to facilitate the overlap, to provide a weathertight seal, and to permit securing nails 12, in the ribs, or with the screws 14, in the valleys of the margin portions.

Figure 2:
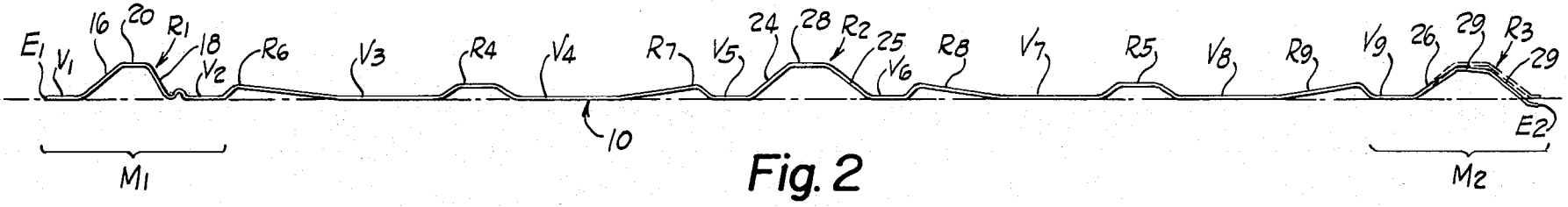
FIG. 2 is an end elevational view of a building panel embodying the present invention, illustrating the complete span or width of the sheet.

A profile of the entire sheet 10 is shown in FIG. 2. The sheet is comprised of three high ribs R1, R2, R3, with the ribs R1, R3 being formed in side marginal portions M1, M2 of the sheet and the rib R2 being formed in a central part of the sheet; two ribs of intermediate height R4, R5 located midway between the high ribs R1, R2 and R2, R3, respectively, and four channel-forming ribs R6, R7, R8 and R9 of lower height than the ribs R4, R5; all extending parallel to the two opposite side edges E1, E2. Sheet portions not forming ribs lie in a common plane P and will be considered for convenience as valleys. The valleys V1, V5 and V9 are specifically suited for receiving fasteners such as screws 14 in the event the sheet is secured in the valleys.

The three high ribs R1, R2, R3 and the two intermediate height ribs R4, R5 impart section strength and rigidity to the building sheet 10 and produce a pleasing board and batten appearance and repeats only twice in each sheet. Each of the four channel-forming ribs R6, R7, R8, R9 is adjacent a high rib and has a long sloping side and a short steep side, with the short side facing the adjacent high rib. When a plurality of sheets are lapped, each high rib is located between two channel-forming ribs so that a repeating pattern is established. The ribs R7 and R9 form guide channels to locate the fasteners in valleys V5 and V9 and add additional section strength to the sheet. The steep side clearly delineates the guide channel while the long slope of the ribs R6-R9 avoids the appearance of too many ribs in the surface of the sheet.

The rib R3 of marginal portion M2, terminating in the edge E2, is formed to locate the edge E2 below the common plane P of the valleys and is sprung to the dotted line position shown in FIG. 2 when it overlaps the marginal portion M1 of an adjacent sheet. This distortion and the resilience of the sheet assure a flush, tight, fit of the overlapping marginal portion M2 with the underlapped portion M1 of the adjacent sheet.

The shape of the sheet as shown in profile in FIG. 2 is preferably achieved by forming in flat sheet that typically includes a protective coating; for example, a steel sheet is typically galvanized with a zinc coating. Alternatively, an organic precoat may be used. To avoid cracks in the coating, the bends in the sheet that form the ribs are of a substantial radius, such as a radius of one-fourth inch.

The rib R1 is constructed differently from ribs R2 and R3 to provide a weatherproof juncture at the side lap formed where a marginal portion M2 overlaps marginal portion M1. The rib R1 has two sloping sides 16, 18 that converge in a direction away from the plane P and terminate at a flat top portion 20 parallel to the plane P. The side 18 farthest from the edge E1 extends at a steeper angle from the plane P than does the side 16 and terminates at its base in a drain trough 22 (FIG. 3) formed by a reverse bend 23. The drain trough 22 extends the length of the rib R1.

Ribs R2 and R3 each have sloping sides 24, 25 and 26, 27, respectively, that converge in a direction away from the plane P and terminate in flat top portions 28, 29, respectively. The total width of the rib R3 in the plane P is essentially equal to the width of the rib R1 and drain trough 22 when the rib R3 is biased to its dotted line position of FIG. 2, and is slightly smaller when it is in the solid line position shown in FIG. 2. In this way, the rib R3 accommodates the span of a rib R1 of an identical adjacent sheet, when the sheets are lapped, as in FIGS. 3 and 4. Also, the flat top portion 20 of the rib R1 is essentially equal in width to the top portion 29 of rib R3. When a rib R3 nests upon and in contact with a rib R1 of an adjacent sheet to form the lap joint, as illustrated in FIGS. 3 and 4, the flat top portions 20, 29 are coterminous.

The construction of the rib R1 and the rib R3 produces a gap G between the lapped rib sides 27 and 18 (FIGS. 3 and 4) that prevents the siphoning or capillary flow of water between the overlapped marginal portions M1, M2. The additional marginal structure, specifically flat top portions 20, 29 and flat valley portions V1 and V9, provide flat lapped areas for receiving fasteners to secure the panels to the supporting framework at the side lap.

Advantageously, the drain trough 22 is located directly adjacent the overlapping edge E2 where the gap G between the walls 18, 27 will immediately interrupt any travel of water along what would otherwise be a capillarylike path between the lapped portions. The trough provides a path for the run-off of water that seeps beneath the edge E2 and reaches but does not pass beyond the gap. Because the drain trough 22 is at the bottom of the wall 18, and the gap between the walls 18, 27 extends the entire height of the wall 18, any water that would penetrate the lapped portions M1, M2 must travel in an uphill direction without the aid of capillary attraction. The shape of the gap G provided by the wall portions 18, 22, 23 produces turbulence in any air flow in the gap, which serves to inhibit the passage of entrained water that might otherwise be forced across the gap by the velocity pressure of wind or the like. As a result, the gap between the wall portions 18 and 27 effectively prevents leakage of water in use. By virtue of this drain and gap construction, performance tests indicate sheets of the construction shown and described are suitable not only for steep and normal slopes, but also for use on relatively flap slopes, such as slopes as low as 2 inches of rise in 12 inches of horizontal coverage.

Figure 3:
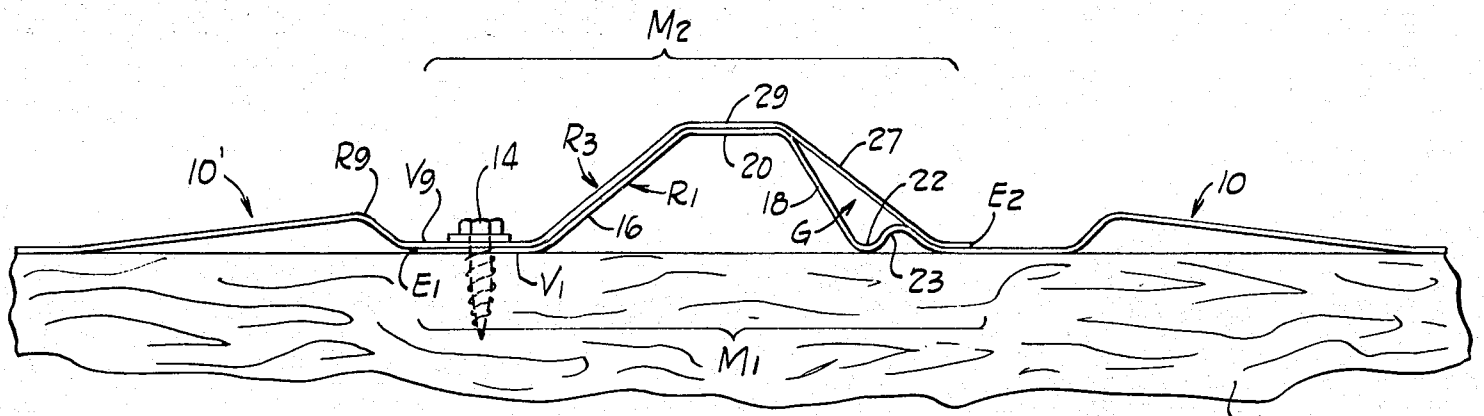
FIG. 3 is a partial end elevational view of a side lapped portion of two identical sheets embodying the present invention, illustrating the manner in which the sheets are fastened to a supporting member in a valley of each sheet; and, FIG. 4 is a partial end elevational view of a side lapped portion of two identical sheets embodying the present invention, illustrating the manner in which the sheets are fastened to a supporting member through a rib of each sheet.
Figure 4:
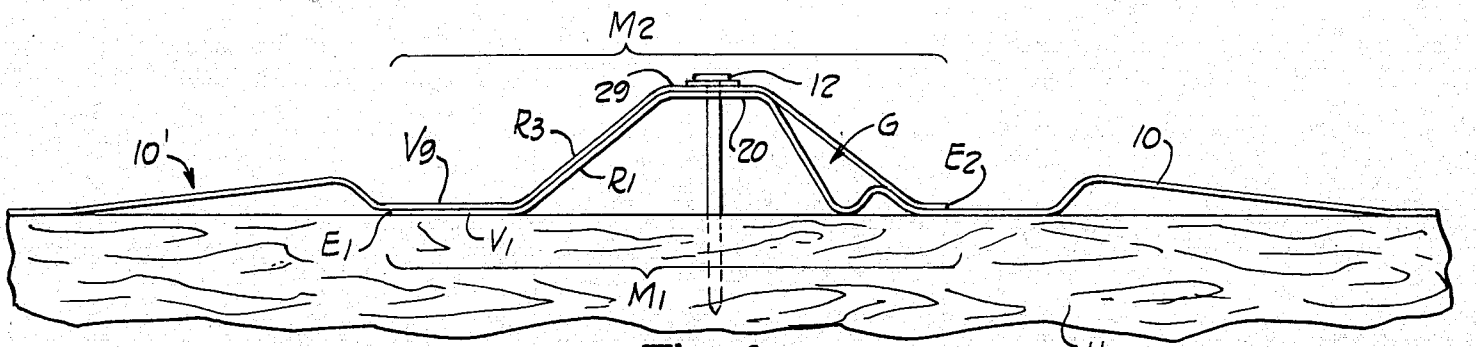

By virtue of the valley portion V1 underlying the full width of the valley V9 defined by the channel-forming rib R9, the lapped valley portions V1 and V9 can be secured with a valley fastener 14, as illustrated in FIG. 3. The location of valley fasteners 14 on the side of the rib R1 remote from the drain groove 22 and the lapping edge E2 assures that any distortion of the sheets occasioned by the application of the fastener 14 will not adversely affect the seal between the edge E2 and the lapped sheet 10.

As shown in FIG. 4, the lapped portion M1, M2 can be secured by a nail 12 through the flat portions 20, 29 of the lapped ribs R1, R3. Because both flat portions 20, 29 are coterminous, a nail in any part of the overlapping flat portion 29 will necessarily pass through the flat top portion 20 of the lapped rib R1 without danger of piercing the side wall 18 or drain 22, which could occasion leakage. In addition, the relatively small span of the flat portions 20, 29 relative to the thickness of the sheets and the height of the ribs reduces the tendency of the ribs to be deformed beneath the head of the fastener 12.

By way of example, in a preferred construction, a sheet 10 is formed of flat stock of galvanized steel 0.0165 inch thick (0.0150 net steel thickness) and 36 inches wide. The three high ribs R1, R2, R3 are each 0.75 inch in height from the plane P and 2.8 inches in width in the plane P. The ribs are spaced 15 inches apart, center to center. The angle of the side walls 16 and 24 with the plane P is 38′, the angle of the wall 26 with the plane P is 35° in the solid line position of FIG. 2 and 38° in the dotted line position, and the angle of the wall 27 with the plane P in 43° in the solid line position and 38° in the dotted line position. Low ribs R4, R5 are each 0.28 inches in height and 1.9 inches wide at the base. Channel-forming ribs R6-R9 are each 0.2 inch in height and 2.2 inches wide at the base. The width of the flat tops 20, 28, 29 are nominally 0.5 inch in width. The valleys V1, V2, V5, V6 and V9 are each 0.75 inch in width. The valleys V3, V4, V7 and V8 are each 2.25 inches in width. All radii of the bends forming the ribs are ¼ inch except the radii of the reverse bend 23 forming the drain groove 22 and the radius at the juncture of side wall 18 with top portion 20, which are ⅛ inch. The width of the sheet 10 after being formed to the shape shown in profile in FIG. 2 is 33.64 inches, or a reduction of only 2-⅜ inches from the starting width. The effective covering span of the formed sheet 10 is 30 inches due to the overlap of marginal portions M1 and M2. These dimensions have provided a sheet that best achieves the desired combination of high strength, and weathertightness with small loss of sheet width, which are interdependent variables in the sense that the number and height of the ribs, if increased for greater strength, consume significantly greater sheet width, and if reduced for greater sheet width, decrease the section strength and affect the anti-siphon seal at the side lap.

From the foregoing description it will be apparent that the present invention provides a construction that provides good section strength for building sheets to withstand high uniform loadings, that produces an effective weathertight seal at lap junctures, a pleasing appearance, and permits fastening of the sheets at side laps through either a valley or a rib, and that accomplishes all of the foregoing with but a small loss of sheet width. While a preferred embodiment of the invention has been described in detail, it will be understood that various modifications or alterations may be made therein without departing from the spirit and scope of the invention set forth in the appended claims.

What is claimed is:

1. A building sheet suitable for roofing and siding, said sheet having a plurality of formed ribs and first and second marginal portions along opposite edges; said first marginal portion adapted to be overlapped by a second marginal portion of an identical sheet to form a side lap parallel to said ribs; and first and second marginal portions each including a flat valley and a rib adjacent the valley, said rib having a flat top portion and each said rib and valley being adapted to receive a fastener; the top portions of both ribs of the two marginal portions being substantially equal in width and the valleys of both marginal portions being substantially equal in width; a drain groove in the rib of first marginal sheet portion, said drain groove being arcuate in cross section and located at the base of said groove to one side of said flat top portion in a space to be bridged by only a side portion of an overlapping rib; the flat valley of the first marginal portion being on the opposite side of said top flat portion from the drain groove and forming the edge of the sheet; and said second marginal portion of the sheet terminating at the end of its rib, with its valley located inwardly of the rib.

2. A building sheet as set forth in claim 1 wherein said ribs of the marginal portions have side walls that are inclined relative to the flat top portions.

3. A pair of identical building sheets suitable for roofing and siding use, said sheets each having a plurality of high ribs, at least one low rib adjacent each high rib, and a valley between the high and low ribs, one such high and low rib and valley forming a marginal portion of one of said sheets adapted to overlap and interfit with a marginal portion of the other sheet, said overlapped marginal portion terminating in a flat strip that underlies substantially the full width of said marginal valley of the overlapping sheet in full and direct contact therewith, that is located inwardly with respect to the edge of the overlapping sheet from said high rib and that facilitates fastening of both sheets through said marginal valley and flat strip.

4. A pair of building sheets suitable for roofing and siding use with overlapping and lapped marginal portions, said marginal portions each including a flat valley and a rib with a flat top portion, said flat top and valley of each sheet being substantially the same width as the respective top and valley of the other and both the lapped valleys and the laped top portions being adapted to receive fasteners, and an anti-siphon drain along one side and at the base of the rib of the overlapped marginal portion, said drain being arcuate in cross section and covered by only a sloping portion of the rib of the overlapping marginal portion adjacent the edge thereof and located on the opposite side of said rib from the overlapped flat valley.

5. A building sheet suitable for roofing and siding, said sheet having bends that form a plurality of parallel ribs and substantially coplanar valleys, first and second marginal side portions extending parallel to the ribs and valleys, said marginal portions constructed differently, each to form a lap joint with a marginal portion of the other construction on another identical sheet; said first marginal portion being adapted to underlie a marginal portion of identical construction to said second marginal portion, said first marginal portion including a first rib above the plane of the valleys and first and second valleys on opposite sides of the first rib, the first valley terminating in a first edge of the sheet and being of a width sufficient to accommodate a fastener, said first rib having first and second sloping sides that converge in a direction away from the plane of the valleys and having a flat top portion between the sloping sides wide enough to accommodate a fastener, said first sloping side being adjacent the first valley and said second side being adjacent the second valley and steeper in slope than the first side, a trough formed adjacent the base of the second side between the second side and the second valley, the width of the trough and the second side being substantially equal to the width of the first side in the plane of the valleys; said second marginal portion including a second rib above the plane of the valleys and the same height as said first rib, a third valley inwardly of the second rib from the edge of the second marginal portion, said third valley being approximately equal in width to that of said first valley, said second rib having third and fourth sloping sides that converge in a direction away from the plane of the valleys and having a flat top portion between the sloping sides essentially the same width as the flat top portion of said first rib, said third sloping side extending at an angle to the plane of the valleys slightly smaller than that of said first sloping side and the fourth sloping side being at an angle from the flat top portion of the second rib that will bridge a distance equal to the width of the second sloping side and trough and terminate adjacent the plane of the valleys.

6. A sheet as set forth in claim 5 wherein said fourth sloping side terminates below the plane of the valleys.

7. In a lap joint between first and second building sheets, a first rib of the first sheet overlapped by and nested in a second rib of the second sheet, said ribs each having first inclined sides and flat top portions adapted to be lapped in mutual contact, and second inclined sides extending at different angles from a line of mutual contact along the flat top portions to the base of each rib, the second side of the lapped first rib extending at a steeper angle from the top portion than the second side of the lapping second rib and terminating in a drain groove at the base of the lapped rib, said second side of the lapping rib bridging the second side and drain groove of the lapped rib and terminating in an edge of the first sheet at the base of the lapped rib.

8. A lap joint as defined in claim 7 wherein the drain groove has a lip with a radius of at least one-eighth inch that engages said second side of the lapping rib so that diverging surfaces thereof form a gradually increasing gap width in a direction from the juncture between the drain groove lip and said second side of the lapping rib.

* * * * *